US006712865B2

(12) United States Patent
Lu

(10) Patent No.: US 6,712,865 B2
(45) Date of Patent: Mar. 30, 2004

(54) COLORED FLAME CANDLE AND MANUFACTURE THEREOF

(76) Inventor: Xin Lu, 11 Aixi Road, Xinanjiang Town, Jiande City, Zhejiang Province 311600 (CN)

( * ) Notice: Subject to any disclaimer, the term of this patent is extended or adjusted under 35 U.S.C. 154(b) by 0 days.

(21) Appl. No.: 10/205,320

(22) Filed: Jul. 25, 2002

(65) Prior Publication Data

US 2004/0009444 A1 Jan. 15, 2004

(30) Foreign Application Priority Data

Jul. 12, 2002 (CN) ..... 02124149 A

(51) Int. Cl.[7] ..... C11C 5/00; F23D 3/16
(52) U.S. Cl. ..... 44/275; 431/288
(58) Field of Search ..... 44/275; 431/288

(56) References Cited

U.S. PATENT DOCUMENTS 3,582,251 A * 6/1971 Concannon ..... 431/126
4,759,709 A * 7/1988 Luken et al. ..... 431/288
5,250,575 A * 10/1993 Wilson et al. ..... 514/739
6,342,080 B1 * 1/2002 Konaka ..... 44/275

FOREIGN PATENT DOCUMENTS

| | | |
|---|---|---|
| CN | 1043340 A | 6/1990 |
| CN | 1073201 A | 6/1993 |
| CN | 1095099 A | 11/1994 |

* cited by examiner

*Primary Examiner*—Margaret B. Medley
(74) *Attorney, Agent, or Firm*—Nath & Associates PLLC; Harold L. Novick; Marvin C. Berkowitz

(57) ABSTRACT

The present invention discloses a colored flame candle and manufacture thereof. The colored flame candle according to the present invention comprises a candle body and a candle combustion wick, wherein the candle body comprises a primary combustion agent, a higher fatty acid amide and a higher fatty acid triglyceride as the strengt- and flexibility-modifier, a color-forming agent and conventional adjuvant such perfumes and pigments. The colored flame candle according to the present invention has high strength and flexibility, and thus is not easy to be crushed during its manufacture and marketing. Furthermore, the colored flame candle according to the present invention has high flame stability and thus has enhanced quality.

17 Claims, No Drawings

COLORED FLAME CANDLE AND MANUFACTURE THEREOF

BACKGROUND OF THE INVENTION

1. Field of the Invention

The present invention relates to a colored flame candle and manufacture thereof. More particularly, the present invention relates to a colored flame candle with improved strength and flame stability, and manufacture thereof.

2. Brief Description of Art

Conventional colored flame candles are formed of a primary combustion agent, a color-forming agent and other adjuvant, and burn with a colored flame such as red, yellow, blue, green, etc. With respect to the formulations of colored flame candles and processes for manufacturing them, there exist many patent publications. For example, Chinese Patent Application Publication No. CN1043340A discloses a colored flame candle and manufacture thereof, said colored flame candle comprising ethyl carbamate(urethane) as the primary combustion agent, non-toxic organic or inorganic substances, which are soluble in ethyl carbamate, as the color-forming agent, higher fatty alcohols as the strength-modifier, higher fatty acid amides as the lubricating and demoulding agent, higher fatty acids as the agent for improving combustion property, cellulose derivatives as the film-forming agent and a resin solution or melt paraffin as the surface-protecting agent; and Chinese Patent Application Publication No. CN 1073201A discloses a colored flame candle and manufacture thereof, said colored flame candle comprising organic polybasic acid esters as the primary combustion agent, higher fatty acids or higher fatty alcohols as the strength-modifier, higher fatty acid amides as the demoulding agent, metal oxides as the combustion wick modifier and metals or organic salts or complexes thereof as the color-forming agent. However, the colored flame candles disclosed in the prior art are fragile and less flexible and burn with instable flames.

BRIEF SUMMARY OF THE INVENTION

The inventor of the present invention conducted extensive investigation in the field of colored flame candles, aiming to develop a colored flame candle with improved strength of the candle body and good flame stability, and as the result, the inventor of the present invention found that by adding a specific triglyceride during the manufacture of the candle body of the colored flame candle, it is possible to substantially improve the strength of the candle body and that by subjecting the candle combustion wick to a specific treatment, it is possible to result in good flame stability. The present invention is completed based on the above findings.

An object of the present invention is to provide a novel colored flame candle, which overcomes the disadvantages associated with the prior candles, such as fragileness, insufficient flexibility and instable flames, is superior over the prior products and can be manufactured by a simple process with low costs.

Another object of the present invention is to provide a process for manufacturing the above-mentioned novel colored flame candle.

Therefore, the present invention in its one aspect provides a colored flame candle, comprising a candle body and a candle combustion wick, wherein the candle body comprises a primary combustion agent, a higher fatty acid amide and a higher fatty acid triglyceride as the strength- and flexibility-modifier, a color-forming agent and conventional adjuvant such as perfumes and pigments.

The present invention in its second aspect provides a process for manufacturing a colored flame candle, comprising forming a uniform melt mixture of components for constituting the candle body, casting said mixture into a mould containing a candle combustion wick therein, cooling and then demoulding.

DETAILED DESCRIPTION OF THE INVENTION

The colored flame candle according to the present invention comprises a candle body and a candle combustion wick, wherein said candle body comprises the following components:

| | |
|---|---|
| Primary combustion agent | 60–99% by weight |
| Higher fatty acid amide | 1–15% by weight |
| Higher fatty acid triglyceride | 1–15% by weight |
| Color-forming agent | 1–10% by weight |
| Perfume and Pigment | q.s. |

wherein said percent by weight is calcuated on the basis of the total weight of said candle body.

The primary combustion agent to be used in the candle body of the colored flame candle according to the present invention can be those conventionally employed in the art and examples thereof may include paraformaldehyde, ethyl hydroxyformate, paraffins, ceresin, ethyl carbamate (urethane), sorbic anhydride, organic polybasic acid esters, polyethylene glycols, hexamethylene-tetramine (urotropine), stearic acid, vinyl acetate-ethylene copolymer resins(EVA), etc., and mixtures thereof, preferably ethyl carbamate and organic polybasic acid esters such as di-$C_{1-5}$ alkyl oxalate, mono-$C_{1-5}$ alkyl succinate, tri-$C_{1-8}$ alkyl citrate, etc., and mixtures thereof, more preferably dimethyl oxalate, monomethyl succinate, trimethyl citrate, most preferably trimethyl citrate. The primary combustion agent is used in an amount of 60 to 99% by weight, preferably 65 to 99% by weight, more preferably 75 to 98% by weight, based on the total weight of the candle body.

The higher fatty acid amide to be used in the candle body of the colored flame candle according to the present invention can be $C_{10-30}$ fatty acid amides, such as caprylamide, capramide, lauramide, tridecanamide, myristamide, palmitamide, stearamide, oleamide, etc., and mixtures thereof, preferably myristamide or stearamide. Said higher fatty acid amide is used in an amount of 1 to 15% by weight, preferably 1.5 to 10% by weight, based on the total weight of the candle body.

The higher fatty acid triglyceride to be used in the candle body of the colored flame candle according to the present invention may be $C_{10-30}$ fatty acid triglycerides, such as glycerin tricaprylate, glycerin tricaprate, glycerin trilaurate, glycerin tri-tridecanoate, glycerin trimyrstate, glycerin tripalmitate, glycerin tristearate(stearin), glycerin trioleate, etc., and mixtures thereof, preferably glycerin trilaurate, glycerin tripalmitate and stearin, most preferably stearin. Said higher fatty acid triglyceride is used in an amount of 1 to 15% by weight, preferably 1.5 to 10% by weight, based on the total weight of the candle body.

The color-forming agent to be used in the candle body of the colored flame candle according to the present invention can be those conventionally employed in the art, and examples thereof may be organic salts such as formates, acetates, stearates and etc., inorganic salts such as halides (for example, chlorides, bromides, etc.), oxycholorides, nitrates, sulfates and etc., of lithium(Li), sodium(Na), potassium(K), boron(B), barium(Ba), calcium(Ca), cesium (Cs), copper(Cu), magnesium(Mg) or antimony(Sb), or complexes of the above-mentioned metals, or mixtures thereof. Said color-forming agent is used in an amount of 1 to 10% by weight, preferably 1.5 to 8% by weight, based on the total weight of the candle body.

The perfumes and pigments to be used in the candle body of the colored flame candle according to the present invention can be those conventionally employed in the art. Examples of perfumes may include santal oil, vanilla, clove oil, mango, lemon oil, etc.; and examples of pigments may include Oil Red, Oil Yellow, Oil Green, Oil Blue, etc. Perfumes or pigments can be used in amounts conventionally employed in the art, for example in amounts of 0.001 to 0.1% by weight, preferably 0.005 to 0.05% by weight, based on the total weight of the candle body.

Besides the above components, the candle body of the colored flame candle according to the present invention can also comprise oxidation accelerators conventionally employed in the art, such as vanadium pentoxide, chromium trioxide and etc. in amounts conventionally employed in the art.

The candle combustion wick of the colored flame candle according to the present invention can be those conventionally employed in the art, such as cotton combustion wick. The candle combustion wick to be used in the colored flame candle according to the present invention may be subjected to a pretreatment by immersing with a solution of the above-mentioned color-forming agent or other reagents according to a conventional manner in the art in a particularly preferred embodiment, the candle combustion wick of the colored flame candle according to the present invention is pretreated by immersing with a 20% aqueous solution of semicarbazide for 10 minutes and then air-drying, whereby the flame stability is substantially enhanced.

The colored flame candle according to the present invention can be manufactured by a method essentially same as one used in the prior art, that is to say, by forming a uniform melt mixture of components for constituting the candle body in a vessel heated at 90 to 95° C., casting the resultant melt mixture into a mould containing a candle combustion wick therein, cooling and then demoulding, thereby a finished product is obtained.

In comparison with the prior colored flame candles, the colored flame candle according to the present invention has high strength and flexibility, and thus is not easy to be crushed during its manufacture and marketing. Furthermore, the colored flame candle according to the present invention has high flame stability and thus has enhanced quality.

The inventive products and the prior products are compared in terms of the strength and flexibility and the results are listed as follows.

| | Item | Static Pressure Test[1] | 1.5 m Free Falling Test[2] | Flexibility Test[3] |
|---|---|---|---|---|
| Comparative Products | Trimethyl citrate 95%<br>Stearic acid 3%<br>Color-forming agent 2% | 3 kg<br>Crushed | Broken | 150 g<br>Broken |
| | Trimethyl citrate 95%<br>Stearamide 3%<br>Color-forming agent 2% | 8 kg<br>Crushed | ½<br>Broken | 350 g<br>Broken |

-continued

| | Item | Static Pressure Test[1] | 1.5 m Free Falling Test[2] | Flexibility Test[3] |
|---|---|---|---|---|
| Inventive Products | Trimethyl citrate 95%<br>Stearamide 1.5%<br>Stearin 1.5%<br>Color-forming agent 2% | 18 kg<br>Not crushed | Unbroken | 760 g<br>Unbroken |

Notes:

[1]Static Pressure is tested as follows: The sample to be tested is a straight candle having a diameter of 5 mm and a length of 5.5 cm. The sample is placed flat on the test table and then a balance weight of 2 kg is placed onto it. The weight of the balance weight is continuously increased until the candle is crushed. The appearance of the candle is observed and the weight of the balance weight applied until the candle is crushed is recorded.

[2]Free Falling is tested as follows: The sample to be tested is a straight candle having a diameter of 5 mm and a length of 5.5 cm. The sample is placed on a test table 1.5 m away from the marble floor and then freely falls onto the marble floor. The appearance of the candle is observed.

[3]Flexibility is tested as follows: The sample to be tested is a straight candle having a diameter of 5 mm and a length of 5.5 cm. The sample is fixed at both ends, with a balance weight being hung in the center of the sample via a 1 mm cotton yarn. The weight of the balance weight necessary for breaking the candle is recorded.

EXAMPLES

The present invention is further demonstrated by the following examples, which shall not be construed as limiting the scope of the present invention.

Example 1

The formulation for the candle body of a candle with a red flame is as follows:

| | |
|---|---|
| Trimethyl citrate | 95% |
| Stearamide | 1.5% |
| Stearin | 1.5% |
| Lithium Propanoate | 2% |
| Clove oil (Perfume) | 0.01% |
| Oil Red (Pigment) | 0.02% |

The above components are melt in a vessel heated at 90 to 95° C. to form a uniform melt mixture, which is then cast into a mould containing a cotton combustion wick which has been previously pretreated by immersing with a 20% aqueous solution of semicarbazide for 10 minutes and then air-drying. After cooling, the candle is demoulded to obtain a finished colored flame candle.

Example 2

The formulation for the candle body of a candle with a yellow flame is as follows:

| | |
|---|---|
| Trimethyl citrate | 95% |
| Stearamide | 1.5% |
| Stearin | 1.5% |
| Sodium citrate | 2% |
| Clove oil (Perfume) | 0.01% |
| Oil Yellow (Pigment) | 0.02% |

The colored flame candle is manufactured in a manner same as Example 1.

Example 3

The formulation for the candle body of a candle with a blue flame is as follows:

| | |
|---|---|
| Trimethyl citrate | 95% |
| Stearamide | 1.5% |
| Stearin | 1.5% |
| Potassium aluminum sulfate | 2% |
| Clove oil (Perfume) | 0.01% |
| Oil Blue (Pigment) | 0.02% |

The colored flame candle is manufactured in a manner same as Example 1.

Example 4

The formulation for the candle body of a candle with a green flame is as follows:

| | |
|---|---|
| Trimethyl citrate | 95% |
| Stearamide | 1.5% |
| Stearin | 1.5% |
| Boric acid | 2% |
| Clove oil (Perfume) | 0.01% |
| Oil Green (Pigment) | 0.02% |

The colored flame candle is manufactured in a manner same as Example 1.

Example 5

The formulation for the candle body of a candle with a violet flame is as follows:

| | |
|---|---|
| Trimethyl citrate | 95% |
| Stearamide | 1.5% |
| Stearin | 1.5% |
| Potassium chloride | 2% |
| Clove oil (Perfume) | 0.01% |
| Pigment Purple | 0.02% |

The colored flame candle is manufactured in a manner same as Example 1.

Example 6

The formulation for the candle body of a candle with a white flame is as follows:

| | |
|---|---|
| Trimethyl citrate | 95% |
| Stearamide | 1.5% |
| Stearin | 1.5% |
| Vanadium chloride | 1% |
| Antimony oxychloride | 1% |
| Clove oil (Perfume) | 0.01% |

The colored flame candle is manufactured in a manner same as Example 1.

Example 7

The formulation for the candle body of a candle with a magenta flame is as follows:

| | |
|---|---|
| Trimethyl citrate | 95% |
| Stearamide | 1.5% |
| Stearin | 1.5% |
| Strontium nitrate | 2% |
| Clove oil (Perfume) | 0.01% |
| Pigment | 0.02% |

The colored flame candle is manufactured in a manner same as example 1.

What is claimed is:

1. A colored flame candle, comprises a candle body and a candle combustion wick, wherein said candle body comprises the following components:

| | |
|---|---|
| Primary combustion agent | 60–99% by weight |
| Higher fatty acid amide | 1–15% by weight |
| Higher fatty acid triglyceride | 1–15% by weight |
| Color-forming agent | 1–10% by weight |
| Perfume and Pigment | q.s. |

wherein said percent by weight is calculated on the basis of the total weight of said candle body.

2. The colored flame candle as claimed in claim 1, wherein said candle combustion wick is pretreated by immersing with a 20% aqueous solution of semicarbazide for 10 minutes and then air-drying.

3. The colored flame candle as claimed in claim 1, wherein said primary combustion agent is selected from the group consisting of paraformaldehyde, ethyl hydroxyformate, paraffins, ceresin, ethyl carbamate (urethane), sorbic anhydride, organic polybasic acid esters, polyethylene glycols, hexamethylene-tetramine (urotropine), stearic acid, vinyl acetate-ethylene copolymer resins (EVA) and mixtures thereof, and is used in an amount of 65 to 99% by weight, based on the total weight of the candle body.

4. The colored flame candle as in claim 3, wherein said primary combustion agent is selected from the group consisting of ethyl carbamate, di-$C_{1-5}$ alkyl oxalate, mono-$C_{1-5}$ alkyl succinate, tri-$C_{1-8}$ alkyl citrate and mixtures thereof.

5. The colored flame candle as claimed in claim 4, wherein said primary combustion agent is trimethyl citrate.

6. The colored flame candle as claimed in claim 1, wherein said fatty acid amide is $C_{10-30}$ fatty acid amides selected from the group consisting of caprylamide, capramide, lauramide, tridecanamide, myristamide, palmitamide, stearamide, oleamide, and mixtures thereof, and is used in an amount of 1.5 to 10% by weight, based on the total weight of the candle body.

7. The colored flame candle as claimed in claim 6, wherein said higher fatty acid amide is stearamide.

8. The colored flame candle as claimed in claim 1, wherein said higher fatty acid triglyceride is $C_{10-30}$ fatty acid triglycerides selected from the group consisting of glycerin tricaprylate, glycerin tricaprate, glycerin trilaurate, glycerin tri-tridecanoate, glycerin trimyristate, glycerin tripalmitate, glycerin tristearate(stearin), glycerin trioleate, and mixtures thereof, and is used in an amount of 1.5 to 10% by weight, based on the total weight of the candle body.

9. The colored flame candle as claimed in claim 8, wherein said higher fatty acid triglyceride is stearin.

10. The colored flame candle as claimed in claim 1, wherein said color-forming agent is organic salts or inorganic salts of lithium(Li), sodium(Na), potassium(K), boron (B), barium(Ba), calcium(Ca), cesium(Cs), copper(Cu), magnesium(Mg) or antimony(Sb), complexes of the above-mentioned metals, or mixtures thereof, and is used in an amount of 1.5 to 8% by weight, based on the total weight of the candle body.

11. A process for manufacturing the colored flame candle as claimed in claim 1, comprising forming a uniform melt mixture of components for constituting the candle body, casting said mixture into a mould containing a candle combustion wick therein, cooling and then demoulding.

12. The colored flame candle as claimed in claim 2, wherein said primary combustion agent is selected from the group consisting of paraformaldehyde, ethyl hydroxyformate, paraffins, ceresin, ethyl carbamate (urethane), sorbic anhydride, organic polybasic acid esters, polyethylene glycols, hexamethylene-tetramine (urotropine), stearic acid, vinyl acetate-ethylene copolymer resins (EVA) and mixtures thereof, and is used in an amount of 65 to 99% by weight, based on the total weight of the candle body.

13. The colored flame candle as claimed in claim 2, wherein said fatty acid amide is $C_{10-30}$ fatty acid amides selected from the group consisting of caprylamide, capramide, lauramide, tridecanamide, myristamide, palmitamide, stearamide, oleamide, and mixtures thereof, and is used in an amount of 1.5 to 10% by weight, based on the total weight of the candle body.

14. The colored flame candle as claimed in claim 2, wherein said higher fatty acid triglyceride is $C_{10-30}$ fatty acid triglycerides selected from the group consisting of glycerin tricaprylate, glycerin tricaprate, glycerin trilaurate, glycerin tri-tridecanoate, glycerin trimyristate, glycerin tripalmitate, glycerin tristearate(stearin), glycerin trioleate, and mixtures thereof, and is used in an amount of 1.5 to 10% by weight, based on the total weight of the candle body.

15. The colored flame candle as claimed in claim 2, wherein said color-forming agent is organic salts or inorganic salts of lithium(Li), sodium(Na), potassium(K), boron (B), barium(Ba), calcium(Ca), cesium(Cs), copper(Cu), magnesium(Mg) or antimony(Sb), complexes of the above-mentioned metals, or mixtures thereof, and is used in an amount of 1.5 to 8% by weight, based on the total weight of the candle body.

16. The colored flame candle as claimed in claim 3, wherein said primary combustion agent is used in an amount of 75 to 98% by weight, based on the total weight of the candle body.

17. The colored flame candle as claimed in claim 12, wherein said primary combustion agent is used in an amount of 75 to 98% by weight, based on the total weight of the candle body.

* * * * *